US010734183B2

(12) United States Patent
Balboni et al.

(10) Patent No.: US 10,734,183 B2
(45) Date of Patent: Aug. 4, 2020

(54) DIGITAL SHUTTER CONTROL FOR BRIGHT FLASH RECOVER IN NIGHT VISION EQUIPMENT

(71) Applicant: Eagle Technology, LLC, Melbourne, FL (US)

(72) Inventors: John A. Balboni, Agawam, MA (US); Raymond Leo Chabot, Chicopee, MA (US)

(73) Assignee: Elbit Systems of America, LLC, Fort Worth, TX (US)

( * ) Notice: Subject to any disclaimer, the term of this patent is extended or adjusted under 35 U.S.C. 154(b) by 20 days.

(21) Appl. No.: 16/223,558

(22) Filed: Dec. 18, 2018

(65) Prior Publication Data

US 2020/0194211 A1 Jun. 18, 2020

(51) Int. Cl.
*H01J 29/98* (2006.01)
*H01J 29/04* (2006.01)
*H01J 31/50* (2006.01)

(52) U.S. Cl.
CPC ..... *H01J 29/98* (2013.01); *H01J 29/04* (2013.01); *H01J 31/50* (2013.01); *H01J 2231/50063* (2013.01)

(58) Field of Classification Search
CPC .. H01J 29/98; H01J 29/04; H01J 31/50; H01J 2231/50063
USPC ..... 250/214 VT
See application file for complete search history.

(56) References Cited

U.S. PATENT DOCUMENTS

| | | | | |
|---|---|---|---|---|
| 3,694,659 | A | 9/1972 | Ramsay et al. | |
| 3,816,744 | A | 6/1974 | Chow | |
| 4,412,128 | A | 10/1983 | McDonald | |
| 5,146,077 | A | 9/1992 | Caserta et al. | |
| 5,747,792 | A | 5/1998 | Kintz et al. | |
| 5,907,150 | A | 5/1999 | Saldana | |
| 6,121,600 | A * | 9/2000 | Saldana | H04N 5/33 250/214 VT |

(Continued)

FOREIGN PATENT DOCUMENTS

KR 90004862 B1 7/1990

OTHER PUBLICATIONS

International Search Report and Written Opinion for related International Application No. PCT/US2019/066572; action dated Apr. 13, 2020; (10 pages).

*Primary Examiner* — Seung C Sohn
(74) *Attorney, Agent, or Firm* — K&L Gates LLP

(57) ABSTRACT

A methodology, for night vision equipment, includes enabling an automatic brightness control (ABC) procedure for a light intensifier having a photocathode that automatically selects a voltage to be applied to the photocathode, sensing current being drawn by the anode, when the current being drawn by the anode exceeds a predetermined threshold, shutting down the photocathode, disabling the ABC procedure, and storing, as a stored voltage value, a value of a voltage that had been selected by the ABC procedure when the current exceeded the predetermined threshold. After a first predetermined period of time, applying a voltage to the photocathode in accordance with the stored voltage value, and after a second predetermined period of time re-enabling the ABC procedure and selecting the stored voltage value as the voltage to be applied to the photocathode.

20 Claims, 4 Drawing Sheets

(56) References Cited

U.S. PATENT DOCUMENTS

| | | | | |
|---|---|---|---|---|
| 7,679,875 | B2 * | 3/2010 | Schneider ..... | H01J 43/30<br>361/87 |
| 9,136,085 | B2 | 9/2015 | Saldana | |
| 2012/0194079 | A1 | 8/2012 | Clauberg et al. | |
| 2016/0255700 | A1 | 9/2016 | Nichols et al. | |

* cited by examiner

DIGITAL SHUTTER CONTROL FOR BRIGHT FLASH RECOVER IN NIGHT VISION EQUIPMENT

FIELD OF THE INVENTION

The present invention relates to night vision equipment, to a power supply for night vision equipment, and, more specifically, to minimizing detrimental effects of bright flashes detected by night vision equipment.

BACKGROUND

Night vision equipment is used for many industrial and military applications. For example, such equipment may be used for enhancing the night vision of aviators, for photographing astronomical bodies and for providing night vision to soldiers or sufferers of retinitis pigmentosa (night blindness). The equipment often incorporates an image intensifier that is used to amplify low intensity light or convert non-visible light into readily viewable images. One such image intensifier is an image intensifier tube.

An image intensifier tube typically includes a photocathode with for example, a gallium arsenide (GaAs) active layer and a microchannel plate (MCP) positioned within a vacuum housing. Visible and infrared energy, for example, may impinge upon the photocathode and be absorbed in the cathode active layer, thereby resulting in generation of electron/hole pairs. The generated electrons are then emitted into the vacuum cavity and amplified by the MCP.

More specifically, when electrons exit the photocathode, the electrons are accelerated toward an input surface of the MCP by a difference in potential between the input surface of the MCP and the photocathode of approximately 200 to 900 volts depending on the MCP to cathode spacing and MCP configuration (filmed or un-filmed). As the electrons bombard the input surface of the MCP, secondary electrons are generated within the MCP. That is, the MCP may generate several hundred electrons for each electron entering the input surface. The MCP is also subjected to a difference in potential between its input surface and its output surface that is typically about 700-1200 volts. This potential difference enables electron multiplication in the MCP.

As the multiplied electrons exit the MCP, the electrons are accelerated through the vacuum cavity toward a phosphor screen (or other anode surface) by yet another difference in potential between the phosphor screen and the output surface of the MCP. This latter potential may be on the order of approximately 4200-5400 volts.

A power supply is generally used to generate and provide the various potential differences noted above and to further provide control voltages for various components of the image intensifier tube. The power supply and intensifier tube are expected to operate under a variety of lighting conditions, including, e.g., relatively low light, relatively high light, and bright flashes. Configuring and controlling a power supply to handle all these conditions can be challenging.

SUMMARY

Described herein are methods for mitigating the effects on light output from night vision equipment in the presence of a bright flash of light. In one embodiment, a method includes enabling an automatic brightness control procedure for a light intensifier having a photocathode, a microchannel plate, and an anode having a phosphor layer, the automatic brightness control procedure selecting a voltage value to be applied to the photocathode in response to light input. The method further includes sensing current being drawn by an element of the image intensifier, and when the current being drawn by the element of the image intensifier exceeds a predetermined threshold, shutting down the photocathode, disabling the automatic brightness control procedure, and storing the voltage value selected by the automatic brightness control procedure when the current exceeded the predetermined threshold. After a first predetermined period of time, the method includes applying a voltage to the photocathode in accordance with the stored voltage value, re-enabling the automatic brightness control procedure and causing the automatic brightness control procedure to select the stored voltage value as the voltage to be applied to the photocathode.

With such an approach, the automatic brightness control procedure can more quickly recover from a flash of light. The instant embodiments are particularly useful in the context of muzzle flashes from a firearm that may last no more than 2-3 ms, but might nevertheless detrimentally impact night vision equipment for, perhaps, hundreds of milliseconds. Embodiments of the invention enable the night vision equipment to recover in about 50 ms.

BRIEF DESCRIPTION OF THE DRAWINGS

Like reference numerals have been used to identify like elements throughout this disclosure.

DETAILED DESCRIPTION

Figure 1:
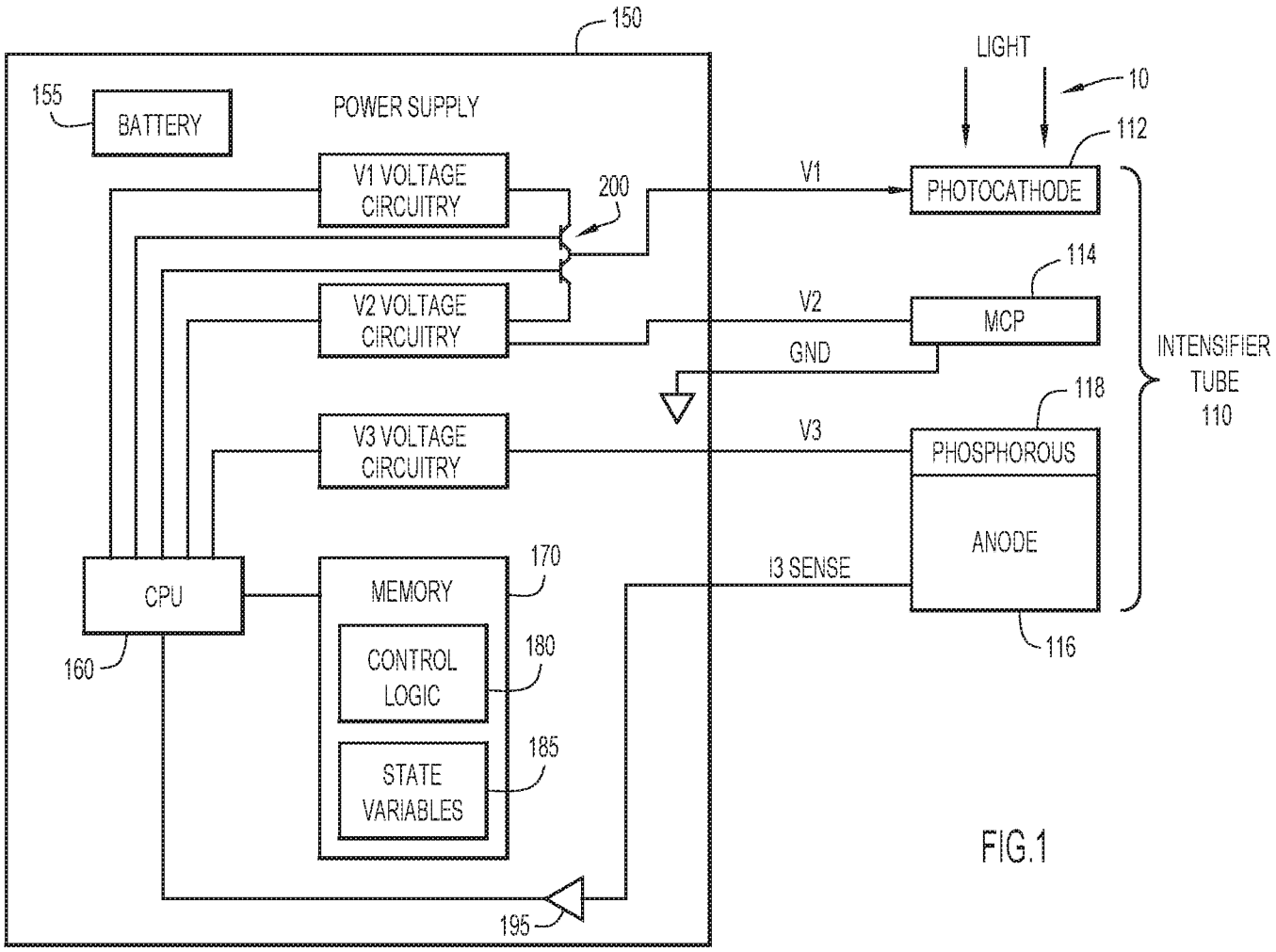
FIG. 1 illustrates a block diagram of a digital power supply and associated image intensifier in accordance with an embodiment of the present invention.

FIG. 1 illustrates a block diagram of a digital power supply and associated image intensifier tube in accordance with an embodiment of the present invention. Specifically, FIG. 1 depicts an image intensifier tube 110 that is powered and controlled by a digital power supply 150. Intensifier tube 110 includes a photocathode 112, a microchannel plate (MCP) 114 and an anode 116 that includes a phosphor layer 118.

Digital power supply (or simply "power supply") 150 includes a battery 155, or other energy source, that supplies power to be used by the power supply 150 and that is delivered to the intensifier tube 110. The power supply 150 further includes a central processing unit (CPU) 160 and memory 170, which stores, among other things, control logic 180 and state variables 185 (discussed further below). Battery 155 supplies power for each of the control voltages V1, V2, and V3, which are respectively applied to components of the intensifier tube 110. The values of these control voltages may be set by CPU 160 in accordance with instructions received from control logic 180.

In one possible implementation, CPU 160 controls circuitry controls the application of voltages V1, V2, V3 to the photocathode 112, MCP 114 and anode 116, respectively. An operational amplifier 195 is configured to sense current I3 flowing in anode 116. Current I3 is representative of the brightness of the light 10 being received at photocathode 112 only where V1 and V2 are not being modified to control the output brightness of the phosphor screen. A value of current I3 can be used by control logic 180 and CPU 160 to, for example, adjust the value of V1 or V2 (e.g., higher V1 or V2 for higher brightness, and lower V1 or V2 for lower brightness).

Figure 2:
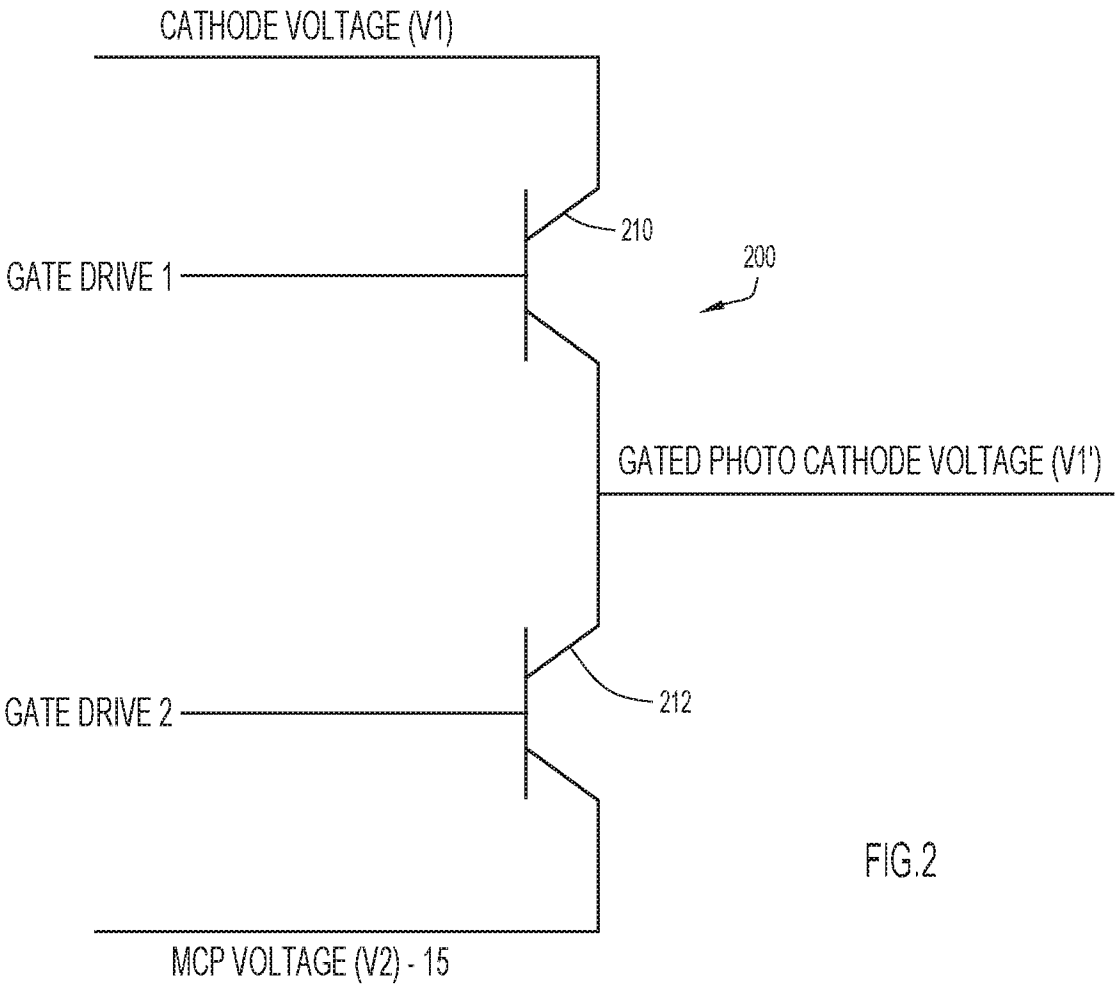
FIG. 2 is a circuit diagram of a switch configuration used to control application of a voltage to the photocathode of the intensifier tube in accordance with an embodiment of the present invention.

FIG. 2 is a circuit diagram of a switch configuration 200 that may be used to control the application of a voltage to the photocathode 112 of the intensifier tube 110 in accordance with an embodiment of the present invention. One advantage of using a digital power supply 150 is the ability not only to switch various voltages on or off, but also to manipulate the waveform(s) of, e.g., the photocathode voltage V1 and/or other control voltages. In this regard, FIG. 2 depicts the connection of the photocathode 112 to the V1 supply voltage. As shown, the photocathode 112 connection is placed between two high voltage transistors 210, 212 which can isolate the photocathode 112 from the two control voltages. In one possible implementation, presented here, the off state of the photocathode 112 is the MCP voltage V2 minus an offset (e.g., 15 volts) to ensure the photocathode 112 experiences a hard reset or reverse bias state.

In operation of the switch configuration 200 of FIG. 2, both gate drives (gate drive 1, gate drive 2) are controlled such that they are not on at the same time, otherwise the photocathode supply voltage V1 would be shorted to the MCP supply voltage V2. The circuit allows the photocathode 112 to be supplied with a gated photocathode voltage V1' that is set to the supply cathode voltage V1 by turning on gate drive 1. As long as transistor 210 is on, the photocathode voltage is fixed. If gate drive 1 is off, the gated photocathode voltage V1' floats. The cycling of the gate drive 1 signal to transistor 210 may be referred to as the "update frequency" or "re-fresh rate" of the intensifier tube 110. An update frequency parameter or re-fresh rate parameter may be stored as one of the state variables 185 and used by CPU 160 to operate the intensifier tube 110. Opening gate drive 2 pulls the gated photocathode voltage V1' to V2-15V, or reverse biases the photocathode 112. This stops any photocathode current from reaching the MCP 114, effectively shutting off an output of the intensifier tube 110.

As noted, an image intensifier and associated power supply that applies the several control voltages are expected to operate under a broad range of conditions, including bright flashes in a dark scene. As further noted, the intensifier tube 110 applies gain via the MCP 114 and corresponding relatively high V2 in low light scenes. A bright flash from, e.g., a muzzle of a firearm, when such gain is applied, can overwhelm, i.e., saturate, the anode current sense operational amplifier 195 causing the intensifier scene to go dark (i.e., the control voltages may be turned down/off in response) until the operational amplifier 195 comes out of saturation, and the control algorithm can regain control. During this potentially "dark" time, the intensifier tube 110 is either at peak output brightness or is totally shutoff, in an attempt to protect itself. Either state leaves the user of the night vision equipment at a disadvantage.

Once the operational amplifier 195 comes out of saturation, in one embodiment, the control circuitry, e.g., in the form of an "automatic brightness control" procedure, takes a finite amount of time to adjust the MCP voltage V2, photocathode voltage V1, and the photocathode gating duty factor (or update frequency or modulation mode), to bring the intensifier gain and output brightness back into a controlled state. This may take a period of time on the order of 300 ms to 500 ms. For example, the MCP 114 may take hundreds of milliseconds to respond to a change in its supplied voltage V2.

A common situation with time frames and brightness levels which send the operational amplifier 195 into saturation is the firing of a 50 caliber machine gun where the muzzle flash, lasting only 2-3 ms, spaced approximately 100 ms apart, overwhelms the circuitry of the device. In such a case, the user must pause from firing to allow the night vision equipment to recover, and then again view the scene.

Embodiments of the present invention address this issue by leveraging the speed of the digitally controlled power supply 150 to decrease the flash response time of the intensifier tube to less than about 50 ms.

In an embodiment of the invention, once a flash (or any bright light) occurs that saturates the anode current (I3) sense operational amplifier 195, control logic 180 is configured to freeze or separately store the previously "in control state variables" (e.g., V1, V2, V3, and/or update frequency/re-fresh rate) as part of state variables 185.

Once the state variables are frozen or separately stored, the photocathode voltage V1 is immediately turned off using, e.g., the switching configuration 200 shown in FIG. 2, under the control of CPU 160. This suppresses the effects of the flash.

The automatic brightness control procedure is also disabled at this time, for a period of time, such that the control voltages are not further altered. Without such a step, all of the control parameters would be pushed to their extreme values in an attempt to dim the intensifier tube in response to the bright light.

After a short time period, e.g., on the order of 6-10 ms (which may be referred to as the "shutter pulse duration"), the photocathode 112 is turned back on by applying its previously known "in control state," i.e., the most recent voltage V1, and other state variables 185 stored/frozen at the time of the detected bright light/flash. This allows the photocathode 112 to again start being responsive to the light conditions in the scene. However, the control logic 180 still does not act on the output of operational amplifier 195 for a total of about 45 ms (referred to as the "shutter flash delay") as the level of anode current I3, as a result of a flash, causes the operational amplifier 195 to still be saturated for that length of time, and as such, the output of operational amplifier 195 may not reliably represent the current light conditions. Under a muzzle flash scenario, the overall scene, after the 6-10 ms delay, should again be dark and the prior state (stored/frozen) state variables 185 should be applicable, and consequently, are used again as soon as the automatic brightness control procedure is allowed to restart. As noted, the automatic brightness control procedure may be re-enabled after a total delay of about 45 ms inclusive of the 6-10 ms shutter pulse duration, a time period that allows the I3 current to decay and the operational amplifier 195 to come out of saturation.

If the operational amplifier 195 is still in saturation after the shutter flash delay of 45 ms, this suggests that the overall scene brightness has changed and the automatic brightness control procedure should be allowed to adjust the control voltages accordingly, without necessarily using the stored state variables 185.

Figure 3:
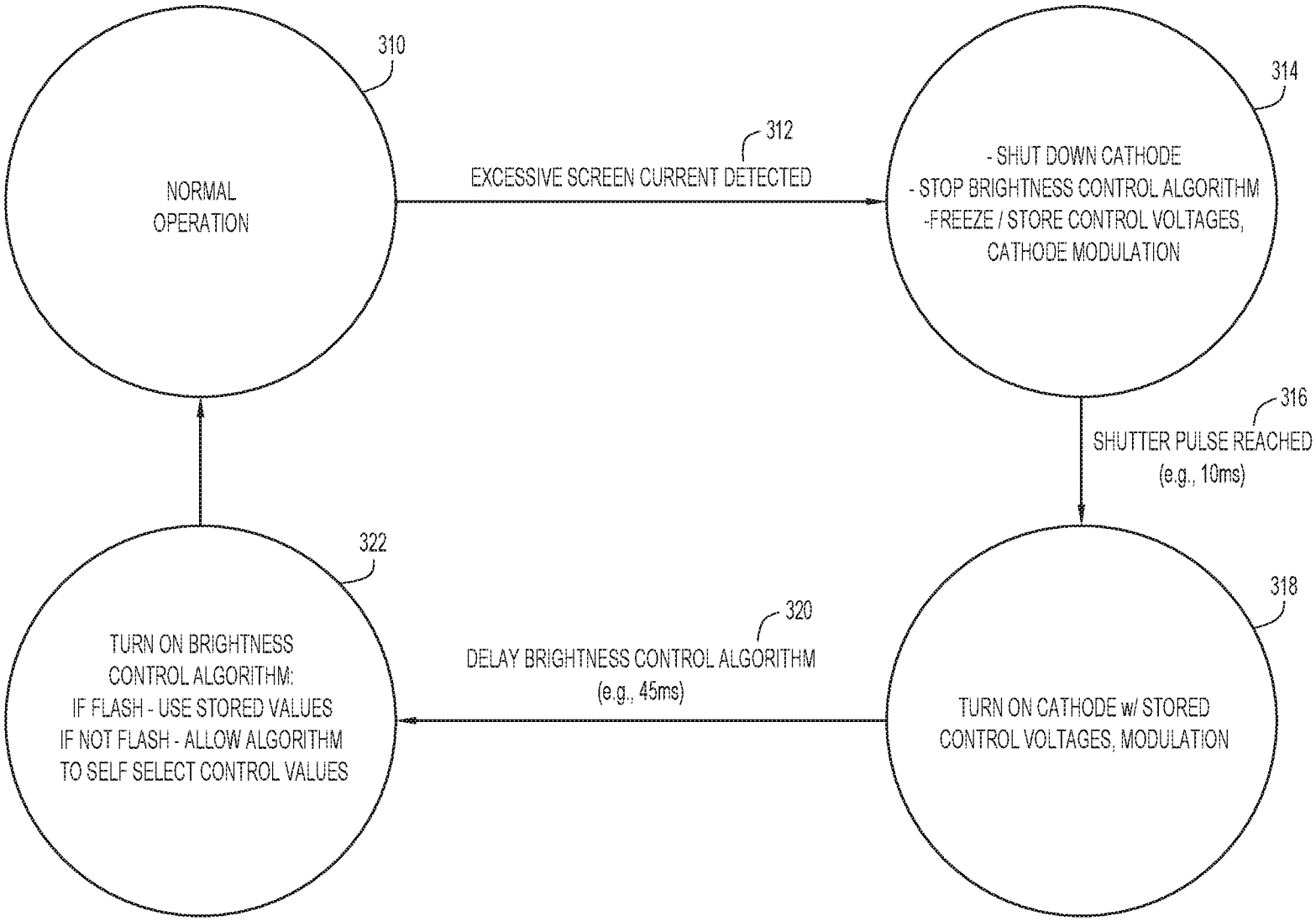
FIG. 3 is a state diagram depicting a series of operations for mitigating the effects of a bright flash in accordance with an embodiment of the present invention.

FIG. 3 is a state diagram depicting a series of operations for mitigating the effects of a bright flash in accordance with an embodiment of the present invention. At 310, an automatic brightness control (ABC) procedure operates to maintain an appropriate level of brightness for a user of the night vision equipment. The ABC may be operating as part of, e.g., control logic 180 in combination with CPU 160 (i.e., digital control), or may function as an analog process, or a combination thereof. The ABC may be considered a type of automatic gain control, which may operate, e.g., linearly from extremely low light conditions to some threshold level of light 10 (such that, e.g., a 5% increase in input light results in a 5% increase in brightness of the phosphor layer 118 of the anode 116), and beyond that threshold of light, as a governor that maintains a predetermined level of brightness from the phosphor layer regardless of the input light level. As will be appreciated by those skilled in the art, the embodiments described herein provide a particular reaction to a particular kind of light event or condition, namely a flash of light, which cannot normally be handled quickly enough by the ABC. For instance, the ABC may control the voltage to the MCP 114, but even if the voltage to the MCP 114 were quickly turned off, it may take on the order of hundreds of milliseconds for the MCP 114 to react in the manner desired to reduce the output brightness of the intensifier tube 110.

As such, if at 312, excessive (above a predetermined threshold) screen current (i.e., anode current I3) is detected by control logic 180, the state of the process proceeds to 314. At 314, control logic 180 shuts down the photocathode by turning off its control voltage V1, stops the operation of the ABC (to avoid the control voltages being potentially incorrectly adjusted in response to the light event), and freezes or stores the then-current control voltages and any photocathode re-fresh rate or update frequency parameters.

At 316, after a predetermined period of time (the shutter pulse delay) of e.g., 6-10 ms, the state of the process proceeds to 318, where the control logic 180 and CPU 160 turn on the photocathode by reapplying the stored control voltage and re-fresh rate.

The process is then delayed, at 320, by a second predetermined period of time (the shutter flash delay), and at 322, the ABC is turned back on. If it was determined at 322, or during the shutter flash delay of 320, that excessive current is not being drawn, this is indicative that the light event was just a flash, and the ABC is re-enabled using the stored values previously used. On the other hand, if at 322, or during the shutter flash delay of 320, it was determined that excessive current was being drawn, this is indicative that the light event was not limited to a flash, but might, in fact, be an overall light level change. In this scenario, the ABC is re-enabled, but permitted to select control voltages autonomously. From 322, the process proceeds back to 310 where the intensifier tube operates under normal conditions.

Figure 4:
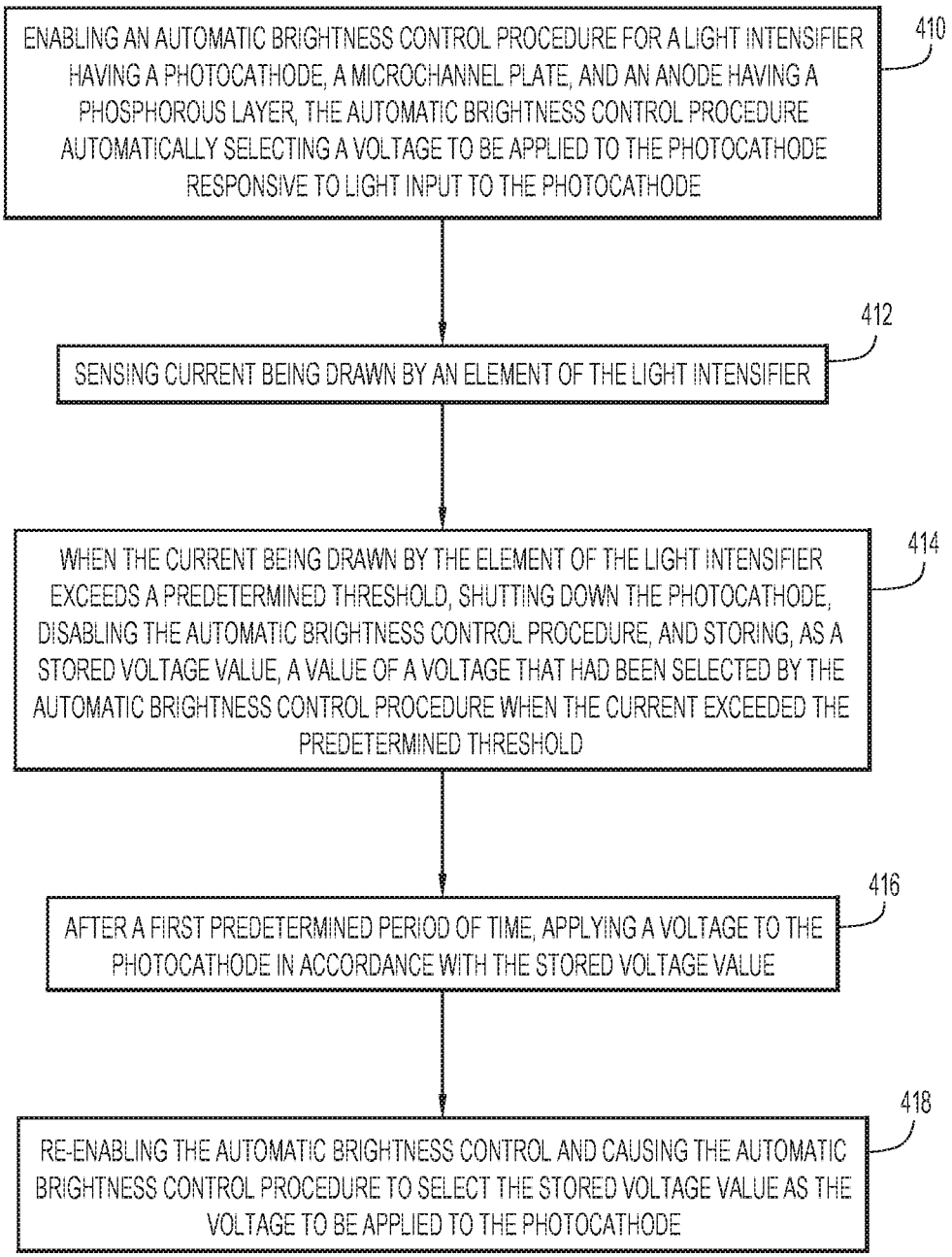
FIG. 4 is a flow chart depicting a series of operations for mitigating the effects of a bright flash in accordance with an embodiment of the present invention.

FIG. 4 is flow chart depicting a series of operations for mitigating the effects of a bright flash in accordance with an embodiment of the present invention. At 410, an operation includes enabling an automatic brightness control procedure for an image intensifier tube having a photocathode, a microchannel plate, and an anode having a phosphor layer, the automatic brightness control procedure automatically selecting a voltage to be applied to the photocathode responsive to light input to the photocathode. At 412, an operation is configured to sense current being drawn by an element of the image intensifier. At 414, when the current being drawn by the element of the image intensifier tube exceeds a predetermined threshold, an operation is configured to shut down the photocathode, disable the automatic brightness control procedure, and store, as a stored voltage value, a value of a voltage that had been selected by the automatic brightness control procedure when the current exceeded the predetermined threshold. At 416, after a first predetermined period of time (e.g., about 10 ms), an operation is configured to apply a voltage to the photocathode in accordance with the stored voltage value. Finally, at 418, an operation is configured to re-enable the automatic brightness control and cause the automatic brightness control procedure to select the stored voltage value as the voltage to be applied to the photocathode.

It is noted that the anode current I3 has been the current relied upon to detect a quick increase in light level. However, those skilled in the art will appreciate that current being drawn by the photocathode or MCP could also be used to trigger the flash recover methodology described herein.

In sum, the embodiments described herein provide faster flash response time for an image intensifier by using a digital shutter made possible by storing the last known "good state" and re-applying those settings after a suitable delay. The embodiments described herein allow the power supply to react more quickly to step changes in light level for all background light levels.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed:

1. A method comprising:

enabling an automatic brightness control procedure for an image intensifier tube having a photocathode, a microchannel plate, and an anode having a phosphor layer, the automatic brightness control procedure selecting a voltage to be applied to the photocathode in response to light input to the photocathode;

sensing current being drawn by an element of the light intensifier tube;

in response to the current being drawn by the element of the image intensifier tube exceeding a predetermined threshold, shutting down the photocathode, disabling the automatic brightness control procedure, and storing, as a stored voltage value, a value of a voltage that had been selected by the automatic brightness control procedure when the current exceeded the predetermined threshold;

after a first predetermined period of time, applying a voltage to the photocathode in accordance with the stored voltage value; and re-enabling the automatic brightness control procedure and causing the automatic brightness control procedure to select the stored voltage value as the voltage to be applied to the photocathode.

2. The method of claim 1, wherein the first predetermined period of time is about 10 ms.

3. The method of claim 1, further comprising re-enabling the brightness control procedure after a second predetermined period of time that is longer than the first predetermined period of time.

4. The method of claim 3, wherein the second predetermined period of time is about 45 ms, inclusive of the first predetermined period of time.

5. The method of claim 1, wherein sensing current comprises sensing whether an operational amplifier used to detect current being drawn by the element is saturated.

6. The method of claim 1, further comprising storing a modulation mode in accordance with a modulation that was being applied to the photocathode when the current being drawn by the element of the light intensifier tube exceeded the predetermined threshold, and applying the modulation mode to the photocathode when re-enabling the automatic brightness control procedure.

7. The method of claim 1, wherein the element of the image intensifier tube is the photocathode.

8. The method of claim 1, wherein the element of the image intensifier tube is the anode having a phosphor layer.

9. The method of claim 1, wherein the method is performed within a power supply for the image intensifier tube.

10. The method of claim 1, wherein the predetermined threshold corresponds to an amount of current drawn in response to a bright flash of light.

11. A night vision device, comprising:

a light intensifier having a photocathode, a microchannel plate, and an anode having a phosphor layer;

a power supply; and a processor, incorporated in the power supply, and configured to:

enable an automatic brightness control procedure for the light intensifier, the automatic brightness control (ABC) procedure automatically selecting a voltage to be applied to the photocathode responsive to light input to the photocathode;

sense current being drawn by the anode;

in response to the current being drawn by the anode exceeding a predetermined threshold, shut down the photocathode, disable the ABC procedure, and store, as a stored voltage value, a value of a voltage that had been selected by the ABC procedure when the current exceeded the predetermined threshold;

after a first predetermined period of time, apply a voltage to the photocathode in accordance with the stored voltage value; and re-enable the ABC procedure and select the stored voltage value as the voltage to be applied to the photocathode.

12. The night vision device of claim 11, wherein the first predetermined period of time is about 10 ms.

13. The night vision device of claim 11, wherein the processor is configured to re-enable the ABC after a second predetermined period of time that is longer than the first predetermined period of time.

14. The night vision device of claim 13, wherein the second predetermined period of time is about 45 ms, inclusive of the first predetermined period of time.

15. The night vision device of claim 11, wherein the processor is configured to sense current by sensing whether an operational amplifier used to detect current being drawn by the anode is saturated.

16. The night vision device of claim 11, wherein the processor is further configured to store a duty factor in accordance with the control parameters that was being applied to the photocathode when the current being drawn by the anode exceeded the predetermined threshold, and apply the stored duty factor to the photocathode when re-enabling the ABC procedure.

17. A power supply for an image intensifier of a night vision device, the power supply comprising:

a battery;

a memory; and a processor, wherein the processor is configured to:

in response to current drawn by an anode of the image intensifier, turn off a switch via which a voltage is supplied to a photocathode of the image intensifier;

store, as a stored voltage value, a value of the voltage in the memory;

after a first predetermined period of time, turn on the switch and re-apply a voltage to the photocathode in accordance with the stored voltage value; and enable an automatic brightness control procedure using the stored voltage value.

18. The power supply of claim 17, wherein the first predetermined period of time is about 10 ms.

19. The power supply of claim 17, wherein the processor is configured to enable the automatic brightness control procedure after a second predetermined period of time that is longer than the first predetermined period of time.

20. The power supply of claim 19, wherein the second predetermined period of time is about 45 ms, inclusive of the first predetermined period of time.

* * * * *